US009833059B2

(12) United States Patent
Westbrook

(10) Patent No.: US 9,833,059 B2
(45) Date of Patent: Dec. 5, 2017

(54) TIE STRAP FOR PERSONAL ITEMS

(71) Applicant: Howard Earl Westbrook, Santa Ana, CA (US)

(72) Inventor: Howard Earl Westbrook, Santa Ana, CA (US)

( * ) Notice: Subject to any disclaimer, the term of this patent is extended or adjusted under 35 U.S.C. 154(b) by 0 days.

(21) Appl. No.: 15/013,882

(22) Filed: Feb. 2, 2016

(65) Prior Publication Data

US 2016/0331105 A1 Nov. 17, 2016

Related U.S. Application Data

(60) Provisional application No. 62/110,804, filed on Feb. 2, 2015.

(51) Int. Cl.
*A45F 5/00* (2006.01)
*A45F 5/02* (2006.01)

(52) U.S. Cl.
CPC ..... *A45F 5/021* (2013.01); *A45F 2200/0516* (2013.01); *A45F 2200/0525* (2013.01)

(58) Field of Classification Search
CPC .... A45F 5/00; A45F 5/02; A45F 5/021; A45F 2200/0516; A45F 2200/0525; Y10T 24/27; Y10T 24/2708
USPC ..... 224/663, 901.2, 901.4, 901.8, 901.6
See application file for complete search history.

(56) References Cited

U.S. PATENT DOCUMENTS 3,503,101 A * 3/1970 Kolozsvary ..... E04H 15/64 135/119
3,542,041 A * 11/1970 Mercorella ..... A45D 8/34 132/273
3,543,977 A * 12/1970 Lockridge ..... A44B 18/00 128/DIG. 15
3,827,107 A * 8/1974 Moore ..... A44B 18/00 128/DIG. 15
4,149,540 A * 4/1979 Hasslinger ..... A61B 17/1322 128/DIG. 15
4,220,302 A * 9/1980 Hampton ..... A61J 9/0676 224/148.6
4,477,005 A * 10/1984 Martinez ..... F41H 9/10 224/218
4,706,914 A * 11/1987 Ground ..... F16B 2/08 24/306
4,759,963 A * 7/1988 Uso, Jr. ..... A01K 97/08 224/901.4

(Continued)

*Primary Examiner* — Peter Helvey
(74) *Attorney, Agent, or Firm* — Roy A. Ekstrand

(57) ABSTRACT

A tie strap includes an elongated flexible strap defining first and second opposed ends, a first surface and a second surface; a first fabric attachment pad secured to the first surface proximate the first end; a second fabric attachment pad secured to the first surface proximate the second end; a third fabric attachment pad secured to the second surface proximate the second end; and a fourth attachment pad secured to a personal item, the personal item being securable to the tie strap by passing the second end of the flexible strap on a first side of a belt or the like and pressing the fourth attachment pad against the second attachment pad and thereafter rotating the second end of the elongated strap and the personal item upwardly and thereafter folding the first end of the flexible strap upon the third fabric attachment pad and pressing the first attachment pad against the third attachment pad.

7 Claims, 4 Drawing Sheets

(56) References Cited

U.S. PATENT DOCUMENTS 4,862,563 A * 9/1989 Flynn ..... A44B 18/00 24/306
D305,097 S * 12/1989 Converse ..... D8/394
4,934,646 A * 6/1990 Doyle ..... B65D 63/18 248/205.2
4,939,818 A * 7/1990 Hahn ..... A44B 18/00 24/16 R
D319,382 S * 8/1991 Hunter ..... D13/154
5,214,874 A * 6/1993 Faulkner ..... A01K 87/00 128/DIG. 15
5,433,359 A * 7/1995 Flowers ..... A45F 5/00 224/222
5,503,316 A * 4/1996 Stewart ..... B60R 7/14 224/312
5,535,928 A * 7/1996 Herring ..... A45F 5/021 224/250
D374,815 S * 10/1996 Snow ..... D13/153
5,636,868 A * 6/1997 Ross, Jr. ..... B42D 3/18 116/234
5,711,469 A * 1/1998 Gormley ..... A45F 5/02 224/236
5,749,504 A * 5/1998 Bieker ..... A45F 3/00 224/221
D407,134 S * 3/1999 Lively ..... D22/100
5,927,210 A * 7/1999 Hacker ..... A47B 23/002 108/43
5,927,579 A * 7/1999 Schwabe ..... A45F 5/02 224/269
D415,110 S * 10/1999 Maguire ..... D13/154
5,988,464 A * 11/1999 Butler ..... A45F 3/16 224/148.4
6,049,953 A * 4/2000 McCay ..... A44B 18/00 24/302
6,076,789 A * 6/2000 Jackson ..... A45F 5/02 224/901.4
6,109,497 A * 8/2000 Westcott ..... A45F 5/021 206/359
6,568,981 B1 * 5/2003 Chang ..... A63H 33/048 24/306
6,880,737 B2 * 4/2005 Bauer ..... A45F 5/02 224/246
7,927,311 B1 * 4/2011 Bachelder ..... A45F 5/00 224/148.4
8,225,976 B2 * 7/2012 Meunier ..... A45F 5/02 224/672
2002/0084295 A1 * 7/2002 Martindale ..... A45C 1/04 224/219
2003/0029006 A1 * 2/2003 Pelt ..... A45F 5/022 24/303
2004/0010887 A1 * 1/2004 Cohen ..... A45C 13/26 16/431
2005/0060791 A1 * 3/2005 Garrett ..... A41F 9/002 2/311
2014/0217256 A1 * 8/2014 Young ..... B62J 11/00 248/311.2
2015/0224382 A1 * 8/2015 Hall ..... A63B 69/0059 473/450

* cited by examiner

TIE STRAP FOR PERSONAL ITEMS

CROSS-REFERENCE TO RELATED APPLICATION

This application claims the benefit of and priority under 35 U.S.C. 119(e) of U.S. Provisional Patent Application No. 62/110,804 entitled Wraptye, filed Feb. 2, 2015 in the name of Howard Earl Westbrook, the disclosure of which is incorporated herein by reference.

FIELD OF THE INVENTION

This invention relates generally to small articles such as personal wireless electronic devices and relates particularly to apparatus for use in aiding the user in carrying, securing and transporting the same.

BACKGROUND OF THE INVENTION

With the proliferation of wireless devices such as cell phones and other communication devices as well as numerous devices used in the entertainment industry such as wireless transmitters and body packs, individuals often need to carry multiple devices on their person as they move about and perform. As a result, a need has arisen for a low-cost reliable and convenient apparatus for securing such devices on the user's person or upon other carried items such as purse straps or guitar straps or the like.

Faced with this need, practitioners in the art have endeavored to provide a variety of personal item holders, retainers and holsters all of which have proven to be bulky, costly and inconvenient to use. There arises therefore a long felt and unresolved need in the art for a more efficient and cost-effective convenient apparatus for securing small personal items.

SUMMARY OF THE INVENTION

Accordingly, it is a general object of the present invention to provide a simple low cost tie strap. It is a more particular object of the present invention to provide a convenient easy to use tie strap which facilitates securing devices to a user's belt, instrument strap (such as a guitar strap or the like), purse strap or the like.

In accordance with the present invention there is provided for use in securing a personal item to a belt, or the like, a tie strap comprising: an elongated flexible strap defining first and second opposed ends, a first surface and a second surface; a first fabric attachment pad secured to the first surface proximate the first end; a second fabric attachment pad secured to the first surface proximate the second end; a third fabric attachment pad secured to the second surface proximate the second end; and a fourth attachment pad secured to a personal item, the personal item being securable to the tie strap by passing the second end of the flexible strap on a first side of a belt or the like and pressing the fourth attachment pad against the second attachment pad and thereafter rotating the second end of the elongated strap and the personal item upwardly and thereafter folding the first end of the flexible strap upon the third fabric attachment pad and pressing the first attachment pad against the third attachment pad.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT OF THE INVENTION

Figure 1:
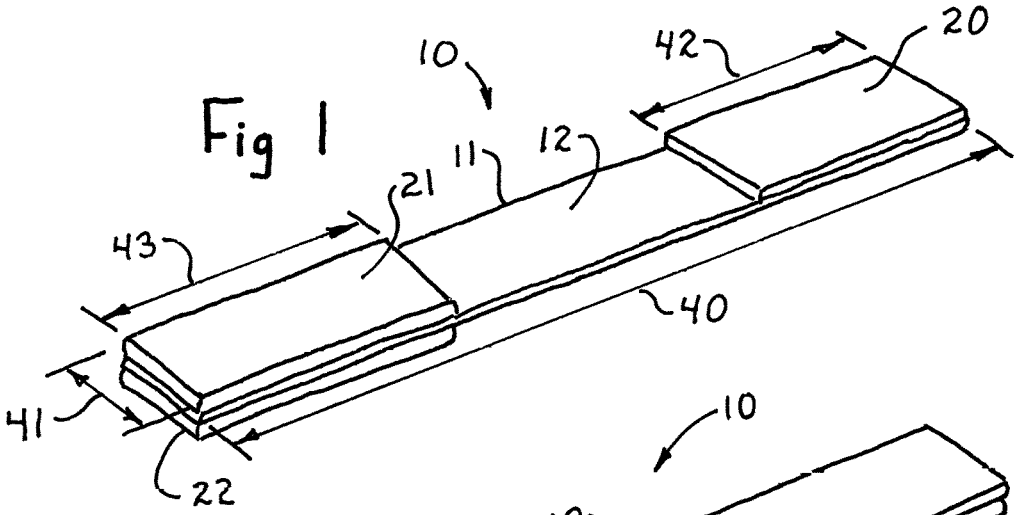
FIG. 1 sets forth a top perspective view of a tie strap for personal items constructed in accordance with the present invention.

FIG. 1 sets forth a top perspective view of a tie strap for personal items constructed in accordance with the present invention and generally referenced by numeral 10. Tie strap 10 is formed of an elongated flexible strap 11 preferably formed of a material such as leather or the like which defines a top surface 12 and a bottom surface 13 (surface 13 seen in FIG. 2). In accordance with the present invention, tie strap 11 supports a fabric attachment pad 20 at one end of strap 11 secured to surface 12 thereof. In further accordance with the present invention strap 11 supports a fabric attachment pad 21 secured to surface 12 at the opposite end of strap 11. Tie strap 10 further includes a third fabric attachment pad 22 secured to surface 13 (seen in FIG. 2) in general alignment with fabric attachment pad 21. Attachment pads 20, 21 and 22 are secured to flexible strap 11 using conventional attachment means such as conventional sewing or stitching or alternatively utilizing a high strength adhesive. The essential function of the selected method used for securing fabric attachment pads 20, 21 and 22 to strap 11 is to provide a secure high strength attachment between the fabric attachment pads and strap 11.

Tie strap 10 may be adjusted in both length and width to accommodate different sized personal articles and user's belt widths. Additionally, the sizes of fabric attachment pads 20, 21, 22 and 23 (pad 23 seen in FIG. 3) may also be adjusted as needed. All such size adjustments are accommodated within the spirit and scope of the present invention. In the example shown in FIG. 1, an overall length 40 may typically vary between ten to thirteen inches with approximately eleven and one half inches being preferred. Similarly, width 41 may vary between one half inch to one and a half inches with one inch being preferred. Finally, fabric attachment pads may vary between two and one half inches to five inches with approximately two and one half inches being preferred for pads 21 and 22 and four and one quarter inches for pad 20 being preferred.

Figure 2:
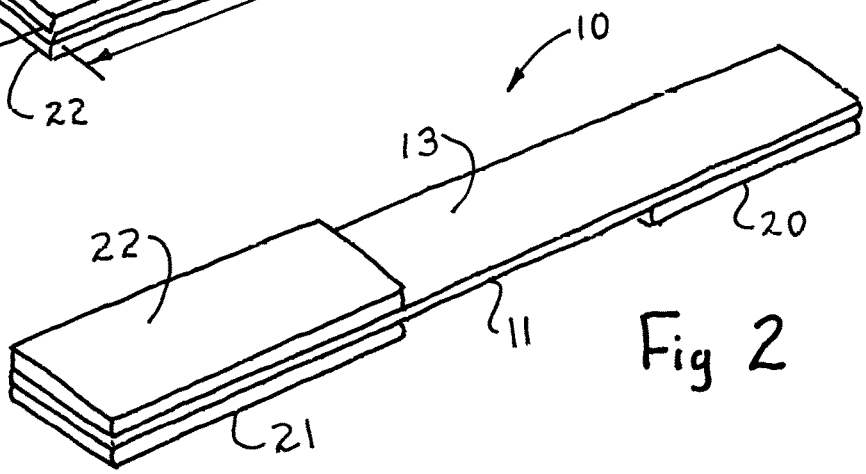
FIG. 2 sets forth a bottom perspective view of a tie strap for personal items constructed in accordance with the present invention.

FIG. 2 sets forth a bottom perspective view of tie strap 10 showing surface 13 supporting fabric attachment pad 22. FIG. 2 also shows fabric attachment pads 20 and 21 secured to surface 12 of flexible strap 11. Once again it will be noted that flexible strap 11 is preferably formed of a flexible material such as leather or the like. Alternatively, flexible strap 11 may be formed of a suitable plastic material to which fabric attachment pads 20, 21 and 22 may be secured FIG. 3 sets forth a perspective view of an illustrative personal item 30 to which a fabric attachment pad 23 has been secured. The attachment of fabric attachment pad 23 to personal item 30 is typically provided by a conventional adhesive or the like. In the illustration shown in FIG. 3, personal item 30 may, for example, be a conventional cell phone or any one of the popular "smart phones". Additionally, personal item 30 may comprise virtually any of the wireless control devices utilized by musicians during performances to control equipment. By way of further addition, personal item 30 may comprise virtually any remote control, or the like, which is desired to be secured upon the user's person and to remain available for use.

Figure 3:
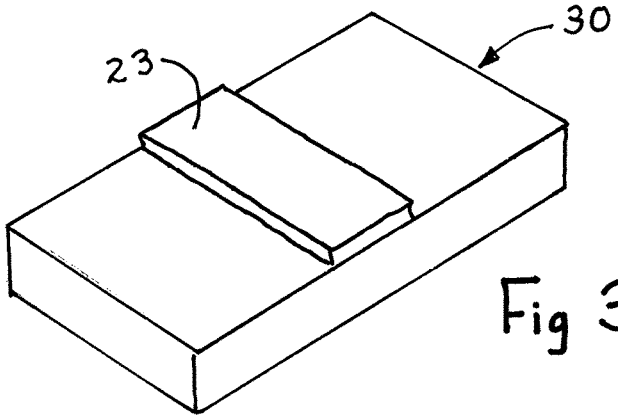
FIG. 3 sets forth a perspective view of an illustrative personal item having a fabric attachment pad secured thereto.

With concurrent reference to FIGS. 1,2 and 3, it will be understood by those skilled in the art that fabric attachment pads 20 through 22 supported upon flexible strap 11 as well as fabric attachment pad 23 secured to personal item 30 preferably comprise combinations of the well-known and popular type of fabric attachment pad generally known in the art as "hook and loop attachment pads". Such hook and loop fabric attachment pads have become extremely prevalent and well-known in the art. One of the most popular manufacturers of such hook and loop fabric attachment pads markets their products under the trademark "VELCRO". Other manufacturers also produce similar hook and loop fabric attachment pads. The basic construction of such fabric attachment pads is provided by the combination of a hook type pad and a loop type pad. Hook type pads are characterized by supporting a plurality of upwardly extending hook shaped elements arranged in a closely spaced array. In contrast, loop type pads support a plurality of flexible curly loop elements arranged in a close array. The hook and loop fabric attachment pads provide a temporary attachment when a hook type pad is pressed against a loop type pad. The hook elements of the hook type pad engage the loop elements of the loop type pad. In the embodiment of the present invention set forth in FIGS. 1, 2 and 3, fabric pads 20 and 21 are loop type pads while pads 22 and 23 are hook type pads. It will be apparent to those skilled in the art that the character of pads 20 through 23 may be reversed using hook pads for pads 20 and 21 and loop pads for pads 22 and 23 without departing from the spirit and scope of the present invention.

Figure 4:
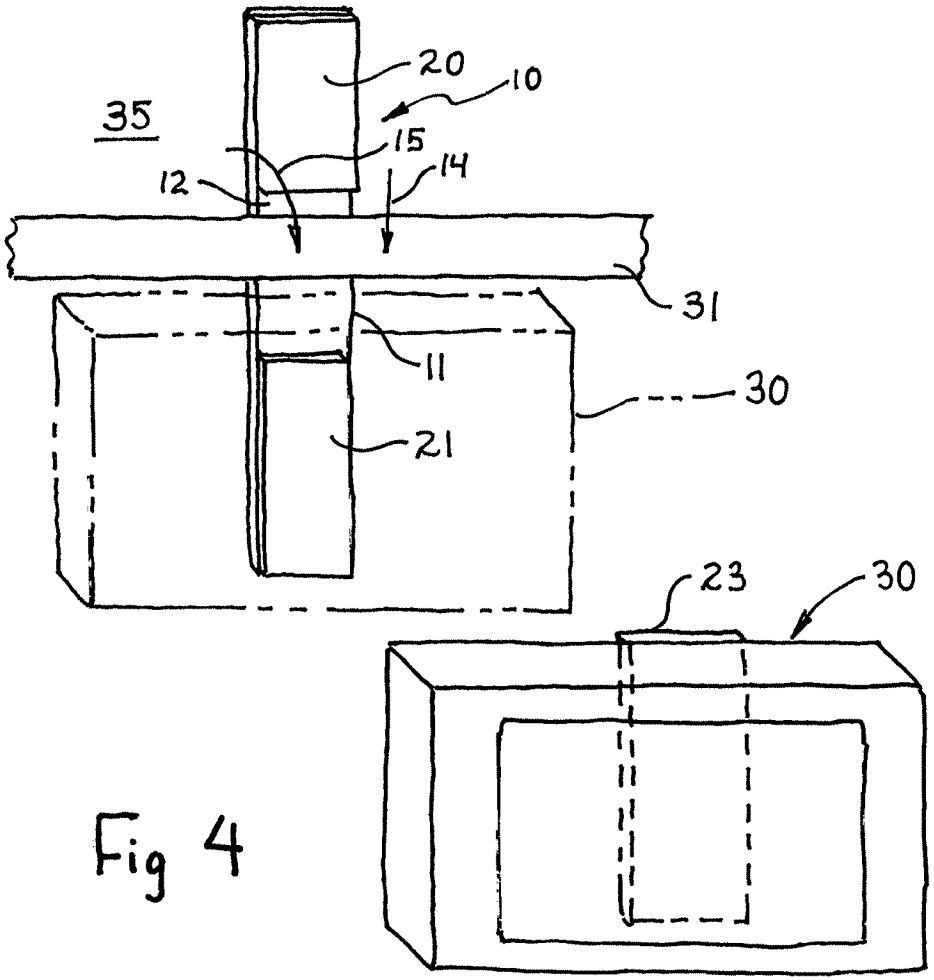
FIG. 4 sets forth a perspective assembly view of the present invention tie strap for personal items receiving an illustrative cell phone for attachment.

FIG. 4 sets forth a perspective assembly view of the application of the present invention tie strap in combination with a personal item, such as a cell phone, which is to be secured to the belt of a user. In the illustration shown in FIG. 4, a user's body 35 supports a typical belt 31 encircling user's body 35. Belt 31 is entirely conventional in fabrication and is used in FIG. 4 for purposes of illustration. It will be apparent to those skilled in the art that the example shown in FIG. 4 is provided solely for illustration and should not be considered by way of limitation. It will be apparent to those skilled in the art from the descriptions which follow that the present invention tie strap may be utilized to secure a variety of personal items to different supporting straps and the like without departing from the spirit and scope of the present invention.

More specifically, FIG. 4 shows a belt 31 encircling a user's body 35 in a typical fashion. In accordance with the anticipated use of the present invention, tie strap 10 having a flexible strap 11 includes a surface 12 upon which a pair of fabric attachment pads 20 and 21 are secured in the manner described above. Tie strap 10 is prepared for use by positioning tie strap 10 against user's body 35 such that surface 12 and fabric attachment pads 20 and 21 face outwardly from user's body 35. Additionally, tie strap 10 is oriented such that fabric attachment pad 20 is at the upper end of strap 11 while fabric attachment pad 21 is at the lower end thereof. Tie strap 10 is then inserted between user's body 35 and belt 31. Tie strap 10 is then moved downwardly in the direction indicated by arrow 14. The downward movement of tie strap 10 is continued until belt 31 is positioned upon surface 12 of tie strap 10 in the manner shown in FIG. 4 such that fabric attachment pad 21 is located as shown in FIG. 4.

As shown and described above in FIG. 3, personal item 30 has a fabric attachment pad 23 secured thereto. Fabric attachment pad 23 is constructed to be cooperative with fabric attachment pad 21 such that personal item 30 may be secured to tie strap 10 by locating personal item 30 against the lower and of tie strap 10 causing fabric attachment pad 23 to cooperatively engage with fabric attachment pad 21. Once this attachment takes place, the lower end of tie strap 10 and personal item 30 assume the configuration shown and described below in FIG. 6A. The sequence of steps by which personal item 30 is secured upon belt 31 is set forth in greater detail in FIGS. 6A through 6C below. Suffice it to note here that once personal item 30 has been secured to the lower and of tie strap 10 through the cooperative engagement of fabric attachment pads 23 and 21, personal item 30 is then rotated upwardly to the position shown and described below in FIG. 6B. Once personal item 30 has been position in this manner, the attachment of personal item 30 is completed by folding the upper end of tie strap 10 bearing fabric attachment pad 20 downwardly in the direction indicated by arrow 15 such that fabric attachment pad 20 is positioned overlying fabric attachment pad 22 (seen in FIG. 2). With fabric attachment pad 20 positioned upon fabric attachment pad 21, the cooperative engagement therebetween secures the upper end of tie strap 10 upon the lower and of tie strap 10 encircling personal item 30 and producing the arrangement shown in FIG. 5 and FIG. 6C.

It will be apparent to those skilled in the art that the removal of personal item 30 is carried forward by simply undertaking the above-described steps in the reverse order. That is to say, personal item 30 is easily removed from its attachment to belt 31 by initially pulling fabric attachment pad 20 from its engagement with fabric attachment pad 22 separating the attachment pads. Thereafter, personal item 30 may be separated from attachment pad 21 by simply pulling personal item 30 and fabric attachment pad 23 away from fabric attachment pad 21 separating personal item 30 from tie strap 10 and making personal item 30 available for use.

Figure 5:
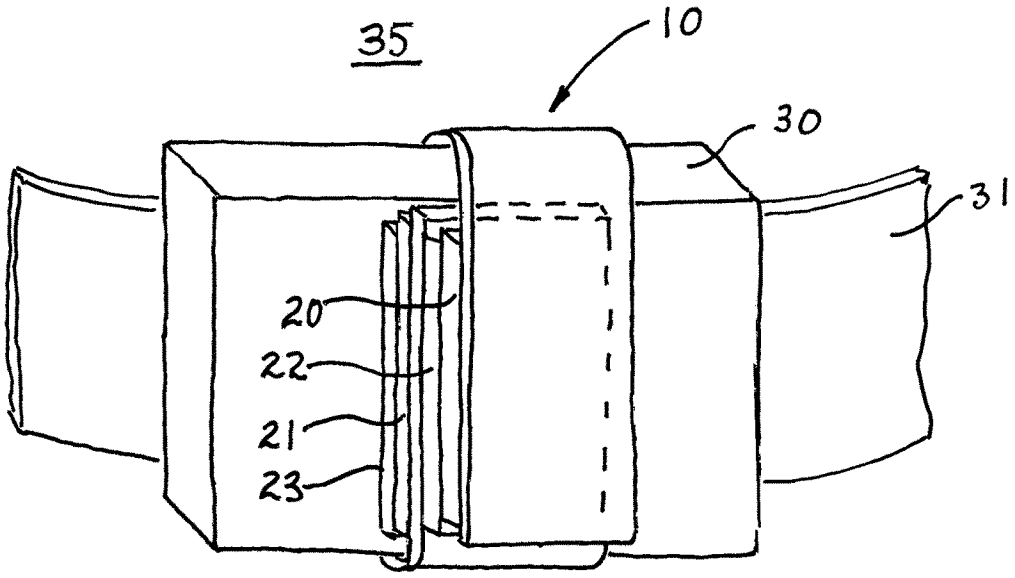
FIG. 5 sets forth a perspective view of the present invention tie strap for personal items supporting the illustrative cell phone item shown in FIG. 4 upon a user's belt.

FIG. 5 sets forth a perspective view of tie strap 10 securing personal item 30 upon user's body 35. It will be noted that in accordance with an important aspect of the present invention tie strap 10 encircles personal item 30 together with belt 31 to securely support and attach personal item 30 upon belt 31. The overlapping of the ends of tie strap 10 and the secure attachment of fabric attachment pads 20 through 23 provides a reliable secure attachment for personal item 30.

Figures 6A, 6B, 6C:
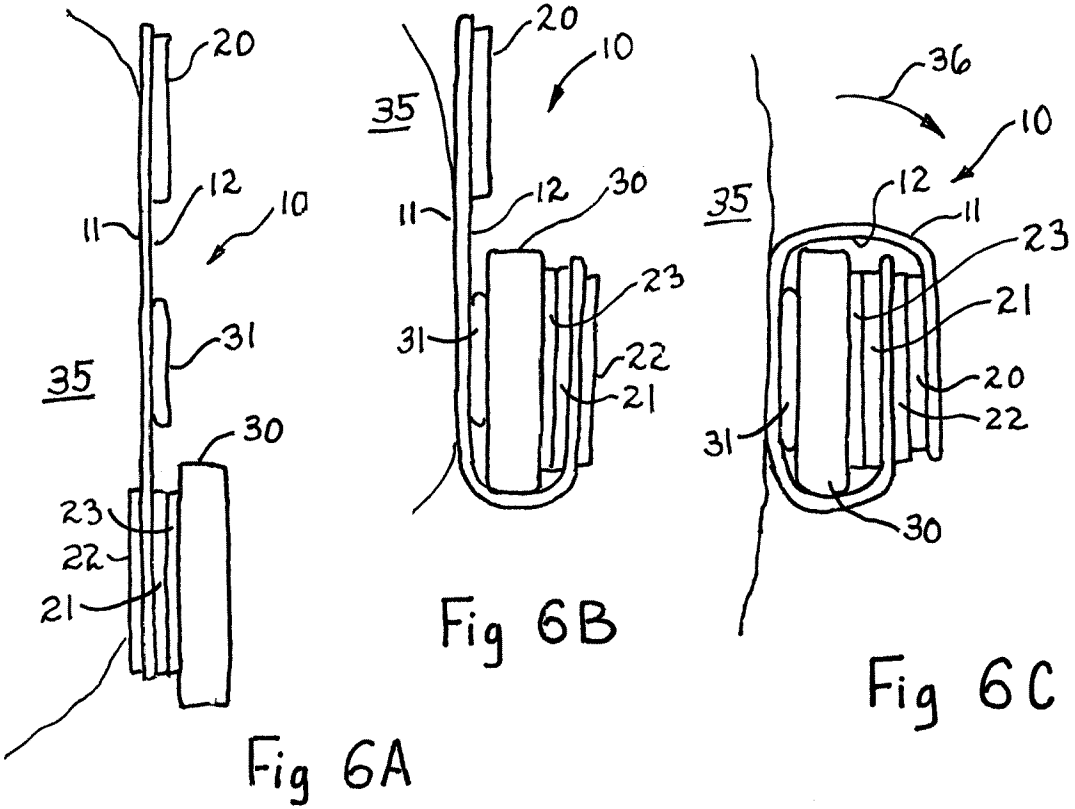
FIGS. 6A through 6C set forth sequential views illustrating the attachment of the illustrative cell phone shown in FIGS. 4 and 5 upon a user's belt.

FIGS. 6A through 6C set forth sequential steps in the operation of the present invention tie strap in securing a personal item 30 to a belt 31 upon the user's body 35. As described above, tie strap 10 includes an elongated flexible strap 11 which defines a top surface 12 and a bottom surface 13 (surface 13 seen in FIG. 2). In accordance with the present invention, strap 11 supports a fabric attachment pad 20 at one end of strap 11 secured to surface 12 thereof. In further accordance with the present invention, strap 11 supports a fabric attachment pad 21 secured to surface 12 at the opposite end of strap 11. Tie strap 10 further includes a third fabric attachment pad 22 secured to surface 13 (seen in FIG. 2) in general alignment with fabric attachment pad 21. The present invention further includes a fabric attachment pad 23, which as is set forth above in FIG. 3, is secured to a selected surface of a personal item 30 which in the example shown may be a cell phone or the like.

FIGS. 6A, 6B and 6C also show a portion of a user's body 35 having a belt 31 supported about the user's waist. Returning to FIG. 6A, the initial step of the use of the present invention tie strap is shown. Initially, tie strap 10 is positioned with respect to user's body 35 such that fabric attachment pads 20 and 21 face outwardly. Thereafter, the user inserts the lower half of tie strap 10 between the interior surface of belt 31 and the underlying surface of user's body 35. Thereafter, personal item 30 is secured to attachment pad 21 by aligning attachment pad 23 and pressing attachment pad 23 against attachment pad 21. The hook material of attachment pad 23 engages the loop material of pad 21 and secures personal item 30 in the position shown in FIG. 6A.

FIG. 6B shows the position of personal item 30 and tie strap 10 following the step of pivoting personal item 30 upwardly in the direction indicated by arrow 35. At this point, attachment pads 21 and 23 remain secured together thereby supporting personal item 30 against the outer surface of belt 31.

FIG. 6C shows the completion of personal item attachment to belt 31 using the present invention tie strap. This final step is provided by folding the upper portion of flexible strap 11 downwardly in the direction indicated by arrow 36 and bringing fabric attachment pad 20 into contact with fabric attachment pad 22. The loop character of pad 20 and the hook character of pad 22 provide the attachment. At this point, tie strap 10 is supporting personal item 30 upon belt 31 in the manner shown in FIG. 5. This completes the attachment of personal item 30 to belt 31. The user may then freely move about confident that personal item 30 will remain secured to belt 31. In the event the user has need of personal item 30 the sequence of steps shown in FIGS. 6 A, 6B and 6C is reversed. Thus, to access personal item 30 the user simply pulls the outer end of tie strap 10 away such that fabric attachment pads 20 and 22 separate. The combination of tie strap 10 and personal item 30 then opens due to gravity to the configuration shown in FIG. 6A. The user then simply pulls personal item 30 away from tie strap 10 thereby separating fabric attachment pads 23 and 21 and freeing up personal item 30.

It will be apparent to those skilled in the art that while a cell phone is shown in the above figures, this use is for purposes of illustration and not limitation. Accordingly, it will be apparent to those skilled in the art that the present invention tie strap may be used to secure a personal item to virtually any strap or belt as desired. For example, attachment may be provided to a purse strap or a guitar strap or other musical apparatus straps without departing from the spirit and the scope of the present invention. Similarly, a variety of personal items commonly used in industries such as the communication and entertainment industries may be secured by the present invention tie strap. Thus, various types of cell phones and smart phones and similar apparatus may be secured using the present invention tie strap. Similarly, various remote controls, body packs, remote transmitters and receivers typical of use in the entertainment industry may also be secured by the present invention ties strap.

What has been shown is a versatile and extremely useful tie strap which may be used to conveniently and efficiently secure personal items of various types as required by the user. The tie strap provided is effective, low cost and extremely easy to master. The present invention tie strap may be fabricated utilizing any one of a variety of flexible strap materials together with attachment apparatus such as the well-known hook and loop fabric attachment pads.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in securing a personal item to a belt, or the like, a tie strap comprising:

an elongated flexible strap defining first and second opposed ends, a first surface and a second surface;

a first fabric attachment pad defining a first interior edge secured to said first surface proximate said first end;

a second fabric attachment pad secured to said first surface proximate said second end, said second fabric attachment pad defining a second interior edge and being spaced from said first fabric attachment pad thereby providing a pad-free space on said first surface, said pad-free space extending from said first interior edge of said first fabric attachment pad to said second interior edge of said second fabric attachment pad;

a third fabric attachment pad secured to said second surface proximate said second end and in general alignment with said second fabric attachment pad; and a fourth attachment pad secured to a personal item, said first and third fabric attachment pads being of different fabric attachment pad types from each other and said second and fourth fabric attachment pads being of different fabric attachment pad types from each other, and said personal item being securable to said tie strap by passing said second end of said flexible strap on a first side of a belt, or the like, placing said pad-free space against the belt and pressing said fourth attachment pad against said second attachment pad and thereafter rotating said second end of said elongated strap and said personal item upwardly and thereafter folding said first end of said flexible strap, carrying said first attachment pad, upon said third fabric attachment pad and pressing said first attachment pad against said third attachment pad.

2. The tie strap set forth in claim 1 wherein said first and second fabric attachment pads are loop type attachment pads and wherein said third and fourth fabric attachment pads are hook type attachment pads.

3. The ties strap set forth in claim 2 wherein said elongated flexible strap is formed of a flexible leather material.

4. For use in securing a personal item to a belt, or the like, a tie strap comprising:

an elongated flat flexible strap defining a substantially rectangular shape having first and second opposed ends, a first surface and a second surface;

a first fabric attachment pad, defining a substantially rectangular shape and a first interior edge, secured to said first surface proximate said first end;

a second fabric attachment pad, defining a substantially rectangular shape and a second interior edge, secured to said first surface proximate said second end defining a pad-free portion of said first surface extending from said first interior edge of said first fabric attachment pad to said second interior edge of said second fabric attachment pad, and;

a third fabric attachment pad, defining a substantially rectangular shape, secured to said second surface in general alignment said second fabric attachment pad and proximate said second end; and a fourth attachment pad secured to a personal item, said first and third fabric attachment pads being of different fabric attachment pad types from each other and said second and fourth fabric attachment pads being of different fabric attachment pad types from each other, and a personal item being securable to said tie strap by passing said second end of said flexible strap on a first side of a belt or the like and pressing said fourth attachment pad against said second attachment pad and thereafter rotating said second end of said elongated strap and the personal item upwardly and thereafter folding said first end of said flexible strap upon said third fabric attachment pad and pressing said first attachment pad against said third attachment pad.

5. The tie strap set forth in claim 1 wherein said first and second fabric attachment pads are hook type attachment pads and wherein said third and fourth fabric attachment pads are loop type attachment pads.

6. The tie strap set forth in claim 1 wherein said first and fourth fabric attachment pads are hook type attachment pads and wherein said second and third fabric attachment pads are loop type attachment pads.

7. The tie strap set forth in claim 1 wherein said first and fourth fabric attachment pads are loop type attachment pads and wherein said second and third fabric attachment pads are hook type attachment pads.

* * * * *